United States Patent [19]

Lauche et al.

[11] Patent Number: 4,652,788

[45] Date of Patent: Mar. 24, 1987

[54] CHANNEL SECONDARY ELECTRON MULTIPLIER

[75] Inventors: Hans Lauche, Katlenburg-Lindau; Wilhelm Barke, Northeim, both of Fed. Rep. of Germany

[73] Assignee: Max-Planck-Gesellschaft zur Foerderung, Goettingen, Fed. Rep. of Germany

[21] Appl. No.: 640,767

[22] Filed: Aug. 14, 1984

[30] Foreign Application Priority Data

Aug. 18, 1983 [DE] Fed. Rep. of Germany ..... 3329885

[51] Int. Cl.[4] ..... H01J 43/00

[52] U.S. Cl. ..... 313/103 CM; 313/103 R; 313/105 CM; 313/105 R; 313/104; 313/376

[58] Field of Search ..... 313/103, 103 CM, 105 CM, 313/106, 104, 450, 105 R, 376

[56] References Cited

U.S. PATENT DOCUMENTS

| | | | |
|---|---|---|---|
| 3,270,234 | 8/1966 | Schaffernicht et al. | 313/450 |
| 3,341,730 | 9/1967 | Goodrich et al. | 313/103 CM |
| 4,305,744 | 12/1981 | Carette et al. | 65/32 |

FOREIGN PATENT DOCUMENTS

| | | | |
|---|---|---|---|
| 1902293 | 10/1969 | Fed. Rep. of Germany . | |
| 1964665 | 7/1970 | Fed. Rep. of Germany . | |
| 2306644 | 8/1974 | Fed. Rep. of Germany | 313/105 CM |
| 0059543 | 4/1983 | Japan | 313/103 CM |
| 1067754 | 5/1967 | United Kingdom | 313/450 |
| 1204260 | 9/1970 | United Kingdom | 313/103 CM |
| 1440037 | 6/1976 | United Kingdom . | |

OTHER PUBLICATIONS

Rev. Sci. Instrum., vol. 41, No. 10, (Oct. 1970), Lester.
Data Sheets X9114AL and X914 BL dated Sep. 1982.

*Primary Examiner*—David K. Moore
*Assistant Examiner*—Michael Razavi
*Attorney, Agent, or Firm*—Handal & Morofsky

[57] ABSTRACT

A channel secondary electron multiplier has a mechanically sturdy body made of metal or ceramic material. The body forms an internal multiplier channel having a curved, e.g. helical main portion and a funnel shaped entrance end. A resistive layer forming a secondary electron emissive surface is provided on the inner wall of said channel inclusive that entrance end. The secondary electron emissive resistive layer in said funnel shaped entrance end has the form of a spiral-shaped band or stripe having a width which is preferably at least approximately equal to the circumferential dimension of the main portion of said channel. The body has a thermal coefficient of expansion which is at least 15% larger than the thermal coefficient of expansion of said layer, to maintain said layer under compression.

14 Claims, 4 Drawing Figures

CHANNEL SECONDARY ELECTRON MULTIPLIER

Figures 1, 1A:
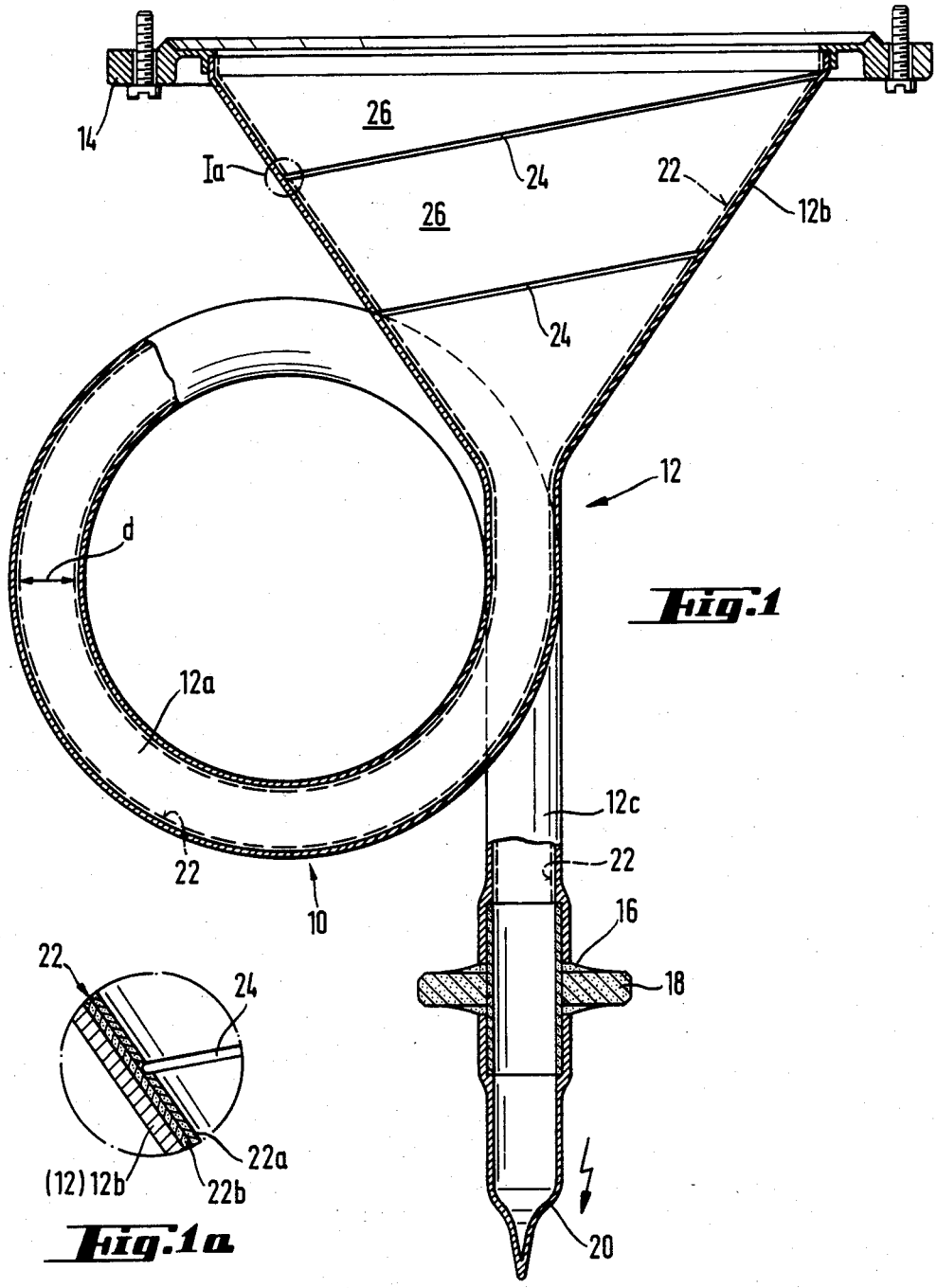

The present invention relates to secondary electron multiplying devices and more specifically to a channel secondary electron multiplier having an elongated curved multiplier channel with a conically enlarged entrance end.

THE PRIOR ART

Channel secondary electron multipliers (in the following in short "channel multipliers") are known e.g. from U.S. Pat. No. 4,305,744, German patent application specification No. 1,964,665, German patent application disclosure document No. 1,902,293, British patent specification No. 1,440,037 and VALVO Data Sheet X914 AL, X914 BL. Such channel multipliers are useful for electron current amplification, e.g. in detectors for electrons, ions, and photons.

The commercial available channel multipliers, which comprise a single tubular multiplier channel, generally consist essentially of a curved tube made of lead glass, the inner surface of which defining a multiplier channel. The entrance end of the multiplier channel may be enlarged to form a funnel, to increase the entrance cross section for the particles to be detected. The active surface of the multiplier channel consists of a layer having a high secondary electron multiplication coefficient and is generally formed by reduction of the lead glass.

Channel multipliers having a body made of a glass tube are mechanically very delicate and therefore limited to relatively small dimensions. This drawback may be avoided, as known from the above mentioned U.S. Pat. No. 4,305,744 by using a mechanically sturdy supporting body made of a ceramic material which defines the multiplier channel. The inner wall of the channel is coated with a layer of lead glass which is reduced at its surface. The glass of the coating and the ceramic of the support body should have essentially the same thermal expansion coefficient; differences up to 8% are regarded as permissible.

The use of a mechanically strong material for the body of the channel multiplier avoids the mechanical limitations which prevents the increase of the dimension of a channel multiplier having a body of lead glass. However, increasing the dimensions of a channel multiplier creates new problems. It has been found that an increase of the diameter of the funnel-shaped entrance end of the multiplier channel does not proportionally increase the collecting ability for the particles to be detected. Further, the operation of the multiplier tends to become instable.

THE INVENTION

It is an object of the invention to provide a channel multiplier with increased useful entrance cross section.

A further object of the invention is to provide a channel multiplier which has a single tubular curved channel and is sturdy and stable in operation.

A still further object of the invention is to provide a channel multiplier which can be manufactured in larger dimensions than the known channel multipliers without impairing the relative collection ability and the stability of operation.

It has been found, that the electrical drawbacks which are created when the dimensions of the entrance end of a channel multiplier of the type mentioned above are increased, have essentially two causes: First, the distribution of the electrical field which collects the primary and secondary electrons in the funnel-shaped entrance end becomes less and less effective in respect of electron collection with increasing dimension of the funnel. Secondly, the active, secondary emissive layer tends to become minute cracks which are regarded as the main cause of the instabilities of operation.

According to a first aspect of the present invention, the secondary emissive layer in the funnel-shaped entrance end is divided by a narrow insulating spiral-shaped gap so that it forms a continuous, spiral-shaped band or stripe-shaped region which follows a spiral path of increasing diameter from the narrow end of the funnel to the entrance end of the channel. This greatly increases the collecting ability in the funnel-shaped entrance end.

According to a further aspect of the present invention, the thermal expansion coefficient of the material of the supporting body is made at least 10% preferably at least 15%, most preferably between 20 to 25% larger than the thermal expansion coefficient of the layer which forms said secondary emissive coating. The layer is applied and/or formed at a temperature, which is higher than the maximum expected operating temperature of the multiplier, e.g. by sintering and fusing a coating of small lead glass particles onto the inner surface of the multiplier channel. Thus, the layer is always subjected to a compressive force which essentially prevents the forming of cracks and even if cracks are formed prevents electrical instabilities at those cracks.

Further objects, features and benefits of the invention will become apparent to those skilled in the art when reading the following description of preferred embodiments of the invention.

IN THE DRAWINGS

Figure 2:
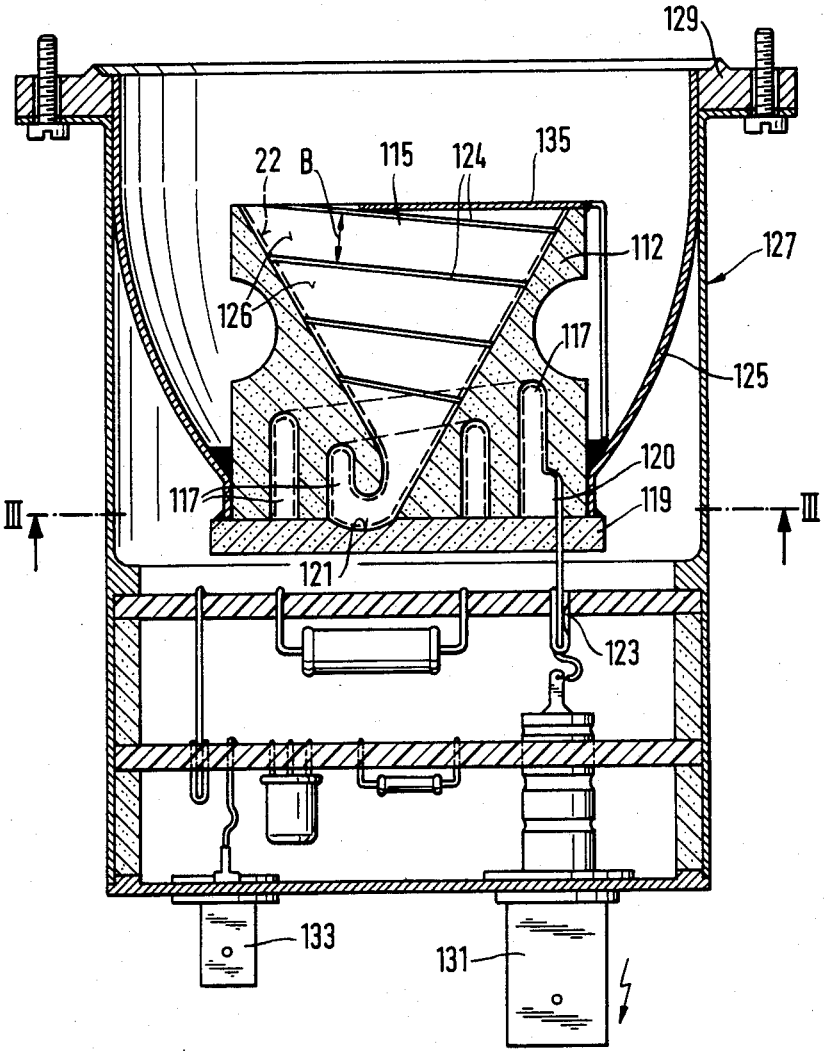
Figure 3:
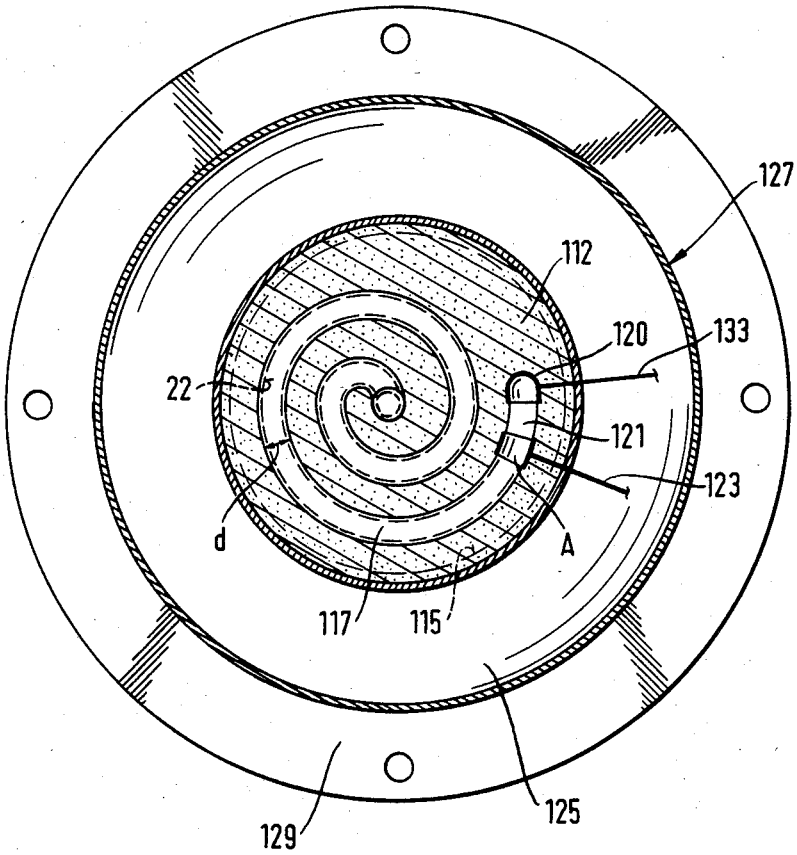

FIG. 1 shows a side view, partially broken away, of a channel multiplier according to a first embodiment of the invention;

FIG. 1*a* is a cross section of a portion of the multiplier of FIG. 1 in an enlarged scale;

FIG. 2 is an axial cross section of a channel multiplier in accordance with a second embodiment of the invention, and FIG. 3 is a section along a line III—III in FIG. 2.

The channel electron multiplier 10 shown in FIG. 1 comprises a supporting body 12 of metal, as stainless steel, which defines a single inner multiplier channel. The body 12 has a curved, more specifically helical main portion **12*a*, the front end of which being integral with a conical funnel 12*b*, the diameter of which increases towards an entrance end 12*d*. The rear end of the body 12 formes a straight section 12*c*. The entrance end of the funnel 12*b* is welded in a vacuum-tight manner to a connecting flange 14. An annular ceramic insulator has one of its sides fused to the end of the straight section 12*c* and its other side to a tubular end portion 20** made of metal and having a sealed rear end.

The inner surface of the metal supporting body 12 is coated with a continuous coating 22 (FIG. **1*a*) made of a lead glass glazing. The free surface of the lead glass glazing coating 22 is reduced to form a resistive layer 22*a* of high secondary emission coefficient. A thin, continuous insulating layer 22*b*, e.g. consisting of unreduced lead glass, must be present between the resistive layer 22*a* and the metal body 12, to avoid short-circuiting the resistive layer. The thin, resistive or semiconducting secondary electron emissive layer 22a forms with the metal wall of the body 12 an electrical capacitor with the unreduced insulating layer 22b** as dielectric. This capacitor may be advantageously used as energy store for the electron avalanche current which increases towards the end of the multiplier channel. This allows to release more secondary electrons per pulse than in the known channel multipliers.

The flange 14 may be used as electrical terminal for the front end of the resistive multiplying layer 22a. The other end terminal may by formed by the metal end portion 20 which in this case operates both as anode and collector electrode and in operation may be supplied with a voltage of about +3000 volts in respect to the flange 14 which may be on ground potential. Alternatively, the terminal at the open end of the funnel 12b may be electrically insulated from the flange 14, e.g. by the glazing or an enamel layer, and a collecting voltage may be applied between the flange 14 and the front end terminal of the resistive layer. In case of primary particles of positive polarity (ions), the flange 14 may be at a potential of −200 V with respect to the voltage at the entrance end of the multiplier channel.

The entrance opening 12d may have a diameter of more than 20 mm, e.g. 25 mm. The dimensions of the main portion of the multiplier channel may be conventional.

A further advantage of fact, that the embodiment of FIG. 1 comprises a supporting body made of metal, is that the good thermal conductivity of the metal body allows high current loadings of the multiplier without imparing the stability.

A preferred method for uniformly coating the relatively large entrance funnel 12b and the narrow main portion 12a of the multiplier channel with the glazing in one step is as follows:

A slurry of creamy consistency is formed by thoroughly mixing finely ground glass powder in a liquid carrier, as isopropyl alcohol. This slurry is preferably applied by pouring the slurry into and through the channel; it may, however, also be applied by other methods, as painting or spraying. The complete layer may be formed at room temperature on the entire surface to be coated and may be visually inspected before fusing.

The applied slurry coating is then preferably dried and heated in a vacuum environment for outgassing. Then, the temperature of the coated body is slowly increased, e.g. to about 800° C., until the coating fuses to form a smooth layer. The fusing is preferably effected in a vacuum furnace following to the outgassing. The final heating to form the smooth surface may be effected in an oxidizing atmosphere. Then the surface of the fused layer is reduced, e.g. as known by heating the layer in a hydrogen atmosphere of 100 to 200 kPa pressure at 370° to 400° C. for about six hours which produces a uniform secondary emissive surface layer having a thickness of about 10 nm. The temperature and duration of the reducing step allow to optimize the resistivity of the secondary emissive layer for a specific channel length and diameter.

The described method of forming the secondary emissive layer by fusing a glass powder coating has the advantage that lower temperatures are sufficient to produce the smooth continuous layer than with the known method, in which melted glass is pressed through the channel, which requires a lower viscosity of the melted glass and, thus, higher temperatures which in turn limit the body materials which can be used.

The effectivity of a given unit area of the secondary emissive layer may be defined as the average number of secondary electrons released per impinging primary particle or electron. The effectivity of the secondary emissive layer in the funnel shaped entrance portion of the known multipliers depends strongly on the ability of the field to draw the secondary electrons into the main portion 12a of the channel. Since enlarging the cross section of the funnel 12b reduces the axial resistance of the layer of the known multipliers and, thus, the field strength, the funnel of the known multiplier provides for an effective collection only in the vicinity of the inner end at the junction to the main portion. The sensitivity decreases strongly towards the entrance opening and soon attains a value, at which no further gain is achieved by further increasing the diameter of the funnel. This drawback is avoided in accordance with an aspect of the present invention by dividing the resistive, secondary electron emissive layer in the funnel by a narrow, spiral shaped, insulating gap so that the layer forms a spiral-shaped continuous band or stripe extending from the secondary emissive layer in the main portion 12a to the entrance opening 12d. The width of the stripe is preferably about equal to the inner circumference of the main portion of the channel 12a at the end connected to the funnel. The width of the stripe may be uniform or tapering to provide an electric field which provides an effective collection of the electrons produced in the funnel. The gap 24 may be produced by grinding or scratching into the semiconductive layer, and the width of the gap should be small compared with the width of the stripe. The gap may also be formed by a rib or groove or any other appropriate configuration of the body 12.

The inner surface of the metal body 12 may be coated with an enamel before applying the described coating which eventually forms the resistive surface layer. An intermediate enamel layer provides for a high dielectric strength and for a high capacity. The fusing temperature of this intermediate enamel layer should be between that of the body and of the later applied glazing.

The embodiment of the present channel multiplier shown in FIGS. 2 and 3 comprises a support body 112 made of an insulating ceramic material. The body 112 has an essentially cylindrical outer wall and forms a single multiplier channel comprising a funnel shaped entrance end 115 and an essentially tubular main multiplier channel portion 117 (see also FIG. 3), which has an essentially plane, spiral-shaped center line. The channel portion 117 is defined by a spiral-shaped recess in the plane back end surface of the essentially cylindrical body 112. Depth and width of the channel portion may be varied to provide for a desired field strength pattern in the channel, e.g. the width may be essentially constant, e.g. 2 mm in the embodiment shown, while the depth increases continuously as shown in FIG. 2. The channel portion 117 is closed by a ceramic disk 119. The curvature of the channel should be essentially uniform and this may be achieved at the junction between the funnel 115 and the channel 117 by an appropriately shaped recess 121 in the disk 119, which provides for smoothly curved junction between the funnel and the spiral-shaped main channel portion 117.

The funnel-shaped entrance end 115 and the spiral-shaped channel portion 117 is provided with a glazing layer which has a secondary emissive surface and may be formed as described with reference to FIG. 1. The secondary emissive resistive layer ends at an anode terminal A, which may be provided by a metal film. A collector electrode 120 which is separated from the anode by an uncoated section 121 of the channel may be provided by a further metal film at the rear end of the channel.

The metal films forming the anode and the collector 120 are electrically connected to appropriate outer terminals 123.

The channel multiplier comprising the body 112 and the disk 119 closing the channel portion 117 is fused or brazed to a tubular connecting member 125. The diameter of member 125 increases towards the front end which is welded or brazed to a front flange 129. An enclosing cylindrical housing 127 also connected to the flange 129 serves for supporting a high voltage terminal 131 and a pulse output terminal 133. The housing may further comprise electrical components, as a preamplifier for the output signal.

The flange 129, the member 125, the body 112 and the disk 119 are preferably hermetically sealed to each other. This allows to connect the flange 129 to an evacuated apparatus while the electrical terminals and components are maintained under atmospheric pressure and, thus, easily accessable.

The secondary emissive layer in the funnel 115 is provided with a narrow insulating gap 124 to form a spiral-shaped stripe 126 for reasons explained with reference to FIG 1. The width B of the stripe is preferably 2 d, wherein d is the width of the channel (FIG. 3). In operation, a potential of +2400 to +3700 volts may be applied to the anode A relative to a terminal 135 at the entrance opening of the funnel 115 which is preferably held at ground potential. The collector 120 may have a potential of about +10 volt to about +150 volts with respect to the anode.

The embodiment described with reference to FIGS. 2 and 3 may be modified by first applying a metal film onto the channel forming surface of the ceramic body 112, e.g. by evaporation or sputtering, and then applying the glazing layer. The metal film is coupled to a reference potential and forms a capacitor together with the secondary emissive surface layer as explained with reference to FIG. 1.

In the embodiments described above, the resistance of the secondary emissive layer between its end terminals may be up to about $10^8$ ohms.

The spiral-helix-shaped stripe formed by the secondary emissive layer in the funnel-shaped entrance portion is preferably essentially coaxial with the funnel axis.

Although the invention has been described above with respect to specific forms of realization, it is evident to those skilled in the art, that it may be modified in various ways. Therefore, it is understood that the present invention should not be limited in the scope except by the terms of the following claims.

We claim:

1. A channel electron multiplier device, comprising
   a supporting body made of a mechanically strong material and defining an elongated tubular multiplier channel which includes a main portion and a funnel-shaped enlarged entrance end, and
   a layer on the surface of said channel, said layer consisting at least in a surface region thereof of a secondary electron emissive, electrically resistive material,
   the improvement consisting in that said secondary emissive resistive layer forms a spiral-shaped stripe in said funnel-shaped entrance end which is divided by a narrow insulating spiral-shaped gap that follows a spiral path of increasing diameter from the narrow end of the funnel to the entrance end of the funnel to greatly increase the collecting ability in the funnel-shaped entrance.

2. The device as claimed in claim 1 wherein said body consists of a ceramic material.

3. The device as claimed in claim 1 wherein said body consists of metal.

4. The device as claimed in claim 1, wherein said stripe has a width in the order of the circumferential dimension of the portion of the channel connecting to said funnel.

5. The device as claimed in claim 1 wherein said funnel has an entrance opening hermetically sealed to a supporting flange.

6. A channel electron multiplier comprising a body made of a mechanically strong material from the group of materials comprising metals and ceramic materials, said body defining an elongated channel having an inner wall,
   a layer of a glassy material on said inner wall, said layer having a resistive, secondary electron emissive surface,
   wherein the material of said body has a coefficient of thermal expansion, which is at least 15 percent larger than that of said glassy material.

7. The device as claimed in claim 1 wherein said body is of metal and an electrically insulating layer is provided between said body and said secondary emissive resistive layer.

8. The device as claimed in claim 1, wherein said body is made of a ceramic material and has first and second opposite surfaces, said first surface comprising a funnel-shaped entrance aperture, said second surface comprising an essentially plane spiral-shaped channel having its inner end connected to a smaller end of said funnel, and an insulating disk (119) sealed to said second surface (FIGS. 2 and 3).

9. The device as claimed in claim 8, characterized in that said disk is provided with a recess at the junction between said funnel and said channel to provide for a smoothly curved connection between said funnel and said channel.

10. A device as claimed in claim 8, wherein the portion of said channel connected to said funnel is narrower than the remainder of the channel.

11. A method of manufacturing a channel-secondary electron multiplier having a body which forms a multiplier channel having an inner wall, said method comprising the steps:
   coating said inner wall with a layer of lead glass powder particles;
   fusing said glass powder coating into a smoothly surfaced layer, and
   reducing the surface of said layer to form secondary emissive, electrically resistive surface layer.

12. The method as claimed in claim 11, wherein the step of applying the coating comprises forming a viscous slurry of lead glass powder in a liquid medium, applying said slurry until said inner surface,
   drying said slurry to form said glass powder coating and then fusing said coating.

13. The method as claimed in claim 9 characterized in that said fusing temperature is not higher than the temperature necessary for forming a fused, glassy layer having a smooth surface.

14. The method as claimed in claim 10, wherein said slurry coating is heated in a vacuum atmosphere, fused in an oxidizing atmosphere and thereafter reduced in a reducing atmosphere.

* * * * *